US006229978B1

(12) United States Patent
Naito et al.

(10) Patent No.: US 6,229,978 B1
(45) Date of Patent: May 8, 2001

(54) HAVING AGGREGATED TONER DISPERSION MEMBER DEVELOPING APPARATUS

(75) Inventors: Hiroaki Naito, Hyogo; Shinichi Yaoi; Katsuya Shimatsu, both of Kawasaki; Jun Shimizu, Hyogo, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/420,789

(22) Filed: Oct. 19, 1999

(30) Foreign Application Priority Data

Feb. 10, 1999 (JP) ..... 11-032488

(51) Int. Cl.[7] ..... G03G 15/08
(52) U.S. Cl. ..... 399/272; 399/281
(58) Field of Search ..... 399/272, 281, 399/252, 274, 284

(56) References Cited

U.S. PATENT DOCUMENTS

| | | | | |
|---|---|---|---|---|
| 4,266,868 | * | 5/1981 | Bresina et al. | 399/272 X |
| 4,982,223 | * | 1/1991 | Yahata | 399/272 X |
| 5,155,532 | | 10/1992 | Sakurada et al. | 355/245 |
| 5,758,241 | * | 5/1998 | Oyama et al. | 399/272 |
| 5,771,429 | * | 6/1998 | Oyama et al. | 399/260 |
| 5,790,929 | * | 8/1998 | Goto et al. | 399/272 X |
| 5,812,911 | | 9/1998 | Asanae | 399/130 |
| 5,943,537 | * | 8/1999 | Ahn | 399/254 |
| 5,995,790 | * | 11/1999 | Takeda | 399/274 |
| 6,035,168 | * | 3/2000 | Masua et al. | 399/254 |
| 6,035,169 | * | 3/2000 | Miyake et al. | 399/282 |

FOREIGN PATENT DOCUMENTS

| | | | |
|---|---|---|---|
| 0 777 159 A2 | | 6/1997 | (EP) . |
| 58-166369 | | 10/1983 | (JP) . |
| 60-49371 | | 3/1985 | (JP) . |
| 63-279261 | | 11/1988 | (JP) . |
| 2-201470 | * | 8/1990 | (JP) . |
| 3-177864 | | 8/1991 | (JP) . |
| 6-161238 | * | 6/1994 | (JP) . |
| 7-20719 | | 1/1995 | (JP) . |
| 8-30078 | | 2/1996 | (JP) . |
| 9-154769 | | 6/1997 | (JP) . |

* cited by examiner

*Primary Examiner*—Quana M. Grainger
(74) *Attorney, Agent, or Firm*—Armstrong, Westerman, Hattori, McLeland & Naughton, LLP

(57) ABSTRACT

The invention provides a developing apparatus which prevents transportation of aggregated toner powder to an image carrier and thereby assures a high print quality by taking a countermeasure to disperse aggregated toner powder when development of an image carrier with developer which includes toner powder and magnetic powder is performed. The developing apparatus includes a developing roller, a developer control member, and an aggregated toner dispersion member disposed in an opposing relationship to the transport magnetic pole of the fixed magnet on the upstream side with respect to the position of the developer control member and having a contact face in the form of a flat face with which the developer held on the outer circumferential face of the developing roller may be contacted under pressure in order to disperse aggregated toner powder in the developer held on the outer circumferential face of the developing roller. The aggregated toner dispersion member is disposed such that the contact face is spaced by a predetermined distance from the outer circumferential face of the developing roller and an angle defined between the tangential direction to the outer circumferential face of the developing roller at the position of the transport magnetic pole of the fixed magnet and the contact face is within a predetermined angle range.

64 Claims, 8 Drawing Sheets

HAVING AGGREGATED TONER DISPERSION MEMBER DEVELOPING APPARATUS

BACKGROUND OF THE INVENTION

1) Field of the Invention

This invention relates to a developing apparatus suitable for use with a printing apparatus of the electrostatic developing type wherein, for example, two-component developer produced by mixing toner powder and magnetic powder is used to develop an image on a photosensitive image carrier.

2) Description of the Related Art

In a printing apparatus which employs electrostatic photography, a photosensitive image carrier (hereinafter referred to as photosensitive drum) in a charged state is first exposed to light of a printing pattern to form an electrostatic latent image on an outer circumferential face of the photosensitive drum. Meanwhile, in a developing apparatus of the printing apparatus, two-component developer produced by mixing toner powder and magnetic powder (carrier) is supplied to an outer circumferential face of a developing roller to form a layer of the developer with a suitable thickness on the outer circumferential face of the developing roller while the developing roller is rotated in contact with the outer circumferential face of the photosensitive drum to develop the electrostatic latent image formed on the photosensitive drum with the developer.

Then, the toner powder image formed on the outer circumferential face of the photosensitive drum in this manner is transferred to printing paper. Thereafter, the non-fixed toner image on the printing paper is fixed by means of a fixing unit to effect desired printing.

In the developing apparatus, the amount of toner powder consumed by printing is calculated from a result of detection of a toner density sensor, a printing density sensor or a like sensor, and an amount of toner powder corresponding to the amount of consumed toner powder is supplemented into the developing apparatus from a toner hopper.

The developing apparatus usually includes, for example, a plurality of agitating and transporting screws, agitation paddles or like members disposed at a position below a toner supplementing port of the toner hopper. The agitating and transporting screws or like members extend in parallel to and are positioned adjacent to each other and rotated to agitate and mix the toner powder and the carrier to produce developer and transport the developer.

The developing roller includes a fixed magnet in the form of a shaft having a plurality of transport magnetic poles, and a rotary sleeve in the form of a hollow tube made of a non-magnetic material such as an aluminum alloy and fitted for rotation around the fixed magnet. The developer can be attracted to an outer circumferential face of the rotary sleeve and transported by the rotary sleeve when the rotary sleeve is driven to rotate.

The developing roller is disposed in the proximity of and in parallel to the photosensitive drum and receives the agitated and mixed developer from the adjacent developer transporting rollers, agitating and transporting screws or like members on the upstream side with respect to the developing region in which the photosensitive drum is developed by the developing roller.

Further, a control member is disposed in parallel to the developing roller over an overall extent of the developing roller on the upstream side with respect to the developing region of the photosensitive drum by the developing roller but on the downstream side with respect to the developer receiving position of the developing roller with a predetermined gap left between the control member and the developing roller. The control member acts to control the amount of developer on the outer circumferential face of the developing roller to a fixed amount and rectify the developer.

In the developing apparatus having the construction described above, toner powder supplemented from the toner hopper is agitated and mixed with carrier and transported as two-component developer by the agitating and transporting screws, agitating paddles or like members. The development is delivered to the developing roller directly or through the developer transporting roller.

The developer delivered to the developing roller is transported by the sleeve of the developing roller being rotated and then is controlled by the control member so that the amount of the developer on the outer circumferential face of the developing roller (the thickness of the developer) may be fixed. Then, only the toner powder in the developer sticks to an electrostatic latent image of the photosensitive drum, thereby to develop the electrostatic latent image on the photosensitive drum.

On the other hand, the carrier in the developer is transported into the developing apparatus again while it is kept attracted to the sleeve of the developing roller also after the development of the photosensitive drum. Then, the carrier is released from the developing roller in the developing apparatus and then collected. The collected carrier is agitated and mixed again with toner powder supplemented from the developing roller by the agitating and transporting screws or the like.

It is to be noted that, in order to facilitate agitation and mixture by the agitating and mixing screws or the like, a technique of shaping particles of toner into a rounded shape is adopted popularly. Further, in order to prevent aggregation of toner powder, a technique of adding an additive to toner powder is employed popularly.

In the developing apparatus described above, the amount of toner powder consumed by printing is calculated from a result of detection of a toner density sensor, a printing density sensor or a like sensor, and an amount of toner powder corresponding to the amount of consumed toner powder is supplemented into the developing apparatus from the toner hopper. Then, in the developing apparatus, the supplemented toner powder is agitated and mixed with carrier using the agitating and transporting screws or like members to produce developer, and the developer is used for development. Thus, in such printing which involves consumption of a large amount of toner powder as continuous printing or printing of a high printing ratio, a large amount of toner powder is supplemented into the developing apparatus from the toner hopper. However, since toner powder has a comparatively small particle size (for example, approximately 6 to 10 $\mu$m), toner powder is liable to be aggregated if a large amount of toner powder is supplemented at a time into the developing apparatus from the toner hopper.

Particularly in a high speed printing apparatus, it is required that agitation and mixing of toner powder and carrier be performed in a short time. However, since the load to the agitation driving system including the agitating and transporting screws and so forth and to the developer increases as the agitation speed by the agitating and transporting screws or the like increases, the agitation speed cannot be raised very much. As a result, developer is transported in a locally aggregated state to the developing roller before it is agitated and mixed sufficiently. If such aggregated toner powder is transferred to printing paper from the photosensitive drum, then a resulting print does not exhibit a good print quality.

SUMMARY OF THE INVENTION

It is an object of the present invention to provide a developing apparatus which prevents transportation of aggregated toner powder to an image carrier and thereby assures a high print quality.

In order to attain the object described above, according to the present invention, a countermeasure is taken to disperse aggregated toner powder when development of an image carrier with developer which includes toner powder and magnetic powder is performed.

More particularly, according to an aspect of the present invention, there is provided a developing apparatus for transporting developer which includes toner powder and magnetic powder to an image carrier to perform development of the image carrier, comprising a developing roller including a fixed magnet having a transport magnetic pole thereon and a rotary sleeve driven to rotate around an outer periphery of the fixed magnet for holding the developer on an outer periphery of the rotary sleeve making use of a magnetic force of the fixed magnet and transporting the developer to a developing region of the image carrier so that the image carrier is developed with the developer in the developing region, a developer control member for controlling the amount of the developer held on an outer circumferential face of the developing roller and simultaneously rectifying the developer, and an aggregated toner dispersion member disposed in an opposing relationship to the transport magnetic pole of the fixed magnet on the upstream side with respect to the position of the developer control member and having a contact face in the form of a flat face with which the developer held on the outer circumferential face of the developing roller may be contacted under pressure in order to disperse aggregated toner powder in the developer held on the outer circumferential face of the developing roller, the aggregated toner dispersion member being disposed such that the contact face is spaced by a predetermined distance from the outer circumferential face of the developing roller and an angle defined between the tangential direction to the outer circumferential face of the developing roller at the position of the transport magnetic pole of the fixed magnet and the contact face is within a predetermined angle range.

With the developing apparatus, since the density of the developer is raised by the contact face of the aggregated toner dispersion member and aggregated toner powder in the developer is crushed and dispersed, such aggregated toner powder does not come to the image carrier at all, and consequently, the print quality can be augmented.

The aggregated toner dispersion member may be disposed such that a position at which the distance between the contact face of the aggregated toner dispersion member and the outer circumferential face of the developing roller is shortest is within a predetermined range which includes the position of the transport magnetic pole of the fixed magnet of the developing roller. Where the aggregated toner dispersion member is disposed in this manner, a crest of the developer is formed by the magnetic force of the fixed magnet between the aggregated toner dispersion member and the outer circumferential face of the developing roller, and the force acting to form such a crest acts as impact force to contact aggregated toner powder under pressure with the contact face of the aggregated toner dispersion member. Further, also aggregated toner powder of a lower layer portion of the developer is dispersed. Consequently, there is an advantage that aggregated toner powder can be dispersed efficiently.

The aggregated toner dispersion member may be disposed such that the developer contacts only with a predetermined region of the contact face of the aggregated toner dispersion member. Where the aggregated toner dispersion member is disposed in this manner, the aggregation density of the developer is increased by it. Consequently, there is an advantage that aggregated toner powder in the developer can be dispersed efficiently.

The developing apparatus may be constructed such that the aggregated toner dispersion member is formed as a member in the form of a plate or a block, and is disposed such that a face thereof opposite to the contact face defines a predetermined angle with respect to a horizontal plane in order to prevent accumulation of the developer on the face of the aggregated toner dispersion member opposite to the contact face. Where the developing apparatus is constructed in this manner, the amount of the developer in the developing apparatus can be maintained fixed, and consequently, there is an advantage that a good print quality can be maintained.

Preferably, the aggregated toner dispersion member is made of a conductive material. In this instance, charge of a polarity same as that of the toner powder can be applied to the aggregated toner dispersion member. Consequently, the toner powder is prevented from sticking to the aggregated toner dispersion member and the quality of the developer can be maintained fixed. Accordingly, there is an advantage that a good printing quality can be maintained and aggregated toner powder can be dispersed with certainty.

Alternatively, the aggregated toner dispersion member may be made of a non-magnetic material. Also in this instance, since the toner powder is prevented from sticking to the aggregated toner dispersion member and the quality of the developer can be maintained fixed, there is an advantage that a good printing quality can be maintained and aggregated toner powder can be dispersed with certainty.

According to another aspect of the present invention, there is provided a developing apparatus for transporting developer which includes toner powder and magnetic powder to an image carrier to perform development of the image carrier, comprising a developing roller including a fixed magnet having a transport magnetic pole thereon and a rotary sleeve driven to rotate around an outer periphery of the fixed magnet for holding the developer on an outer periphery of the rotary sleeve making use of a magnetic force of the fixed magnet and transporting the developer to a developing region of the image carrier so that the image carrier is developed with the developer in the developing region, a developer control member for controlling the amount of the developer held on an outer circumferential face of the developing roller and simultaneously rectifying the developer, a transport roller including a fixed magnet having a transport magnetic pole and a rotary sleeve driven to rotate around an outer periphery of the fixed magnet for holding the developer on an outer circumferential face of the rotary sleeve making use of a magnetic force of the fixed magnet and transporting the developer to the outer periphery of the developing roller, and an aggregate toner dispersion member disposed in an opposing relationship to the transport magnetic pole of the fixed magnet and having a contact face in the form of a flat face with which the developer held on an outer circumferential face of the transport roller may be contacted under pressure in order to disperse aggregated toner powder in the developer held on the outer circumferential face of the transport roller, the aggregated toner dispersion member being disposed such that the contact face is spaced by a predetermined distance from the outer circumferential face of the transport roller and an angle defined between the tangential direction to the outer circumferential face of the transport roller at the position of the transport magnetic pole of the fixed magnet and the contact face is within a predetermined angle range.

Also with the developing apparatus, since the density of the developer is raised by the contact face of the aggregated toner dispersion member and aggregated toner powder in the developer is crushed and dispersed, such aggregated toner powder does not come to the image carrier at all, and consequently, the print quality can be augmented.

The aggregated toner dispersion member may be disposed such that a position at which the distance between the contact face of the aggregated toner dispersion member and the outer circumferential face of the transport roller is shortest is within a predetermined range which includes the position of the transport magnetic pole of the fixed magnet of the transport roller. Where the aggregated toner dispersion member is disposed in this manner, a crest of the developer is formed by the magnetic force of the fixed magnet between the aggregated toner dispersion member and the outer circumferential face of the transport roller, and the force acting to form such a crest acts as impact force to contact aggregated toner powder under pressure with the contact face of the aggregated toner dispersion member. Further, also aggregated toner powder of a lower layer portion of the developer is dispersed. Consequently, there is an advantage that aggregated toner powder can be dispersed efficiently.

The above and other objects, features and advantages of the present invention will become apparent from the following description and the appended claims, taken in conjunction with the accompanying drawings in which like parts or elements denoted by like reference symbols.

DESCRIPTION OF THE PREFERRED EMBODIMENTS

A. First Embodiment

Figure 1:
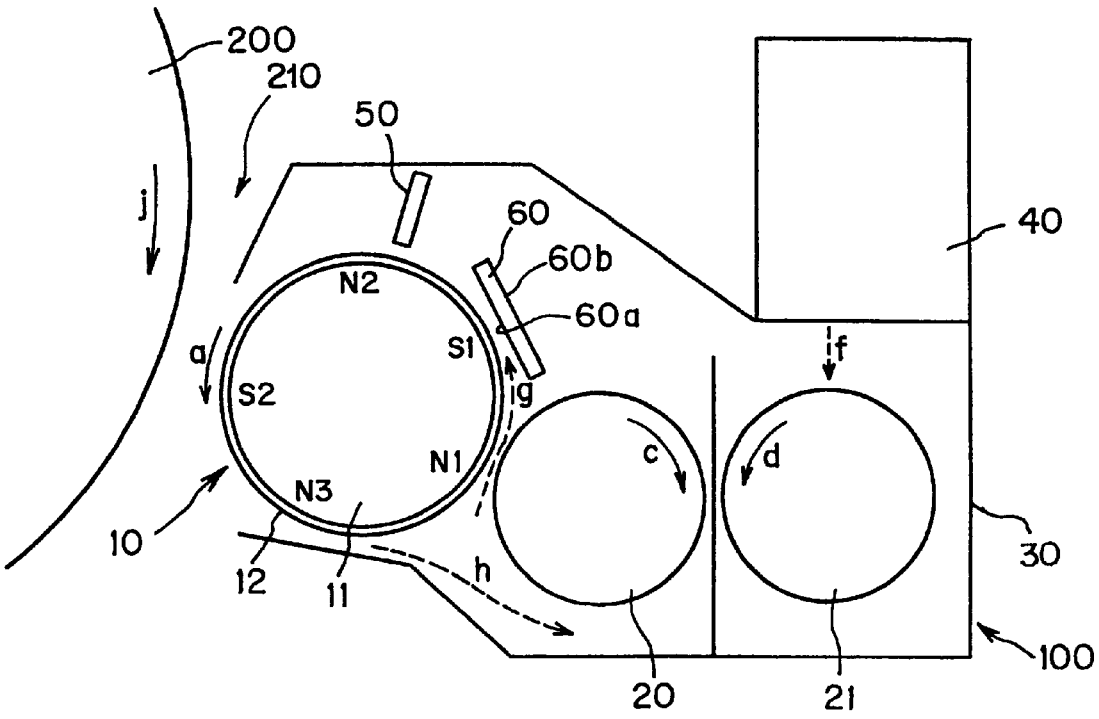
FIG. 1 is a side elevational view schematically showing a construction of a developing apparatus according to a first preferred embodiment of the present invention.
Figure 2:
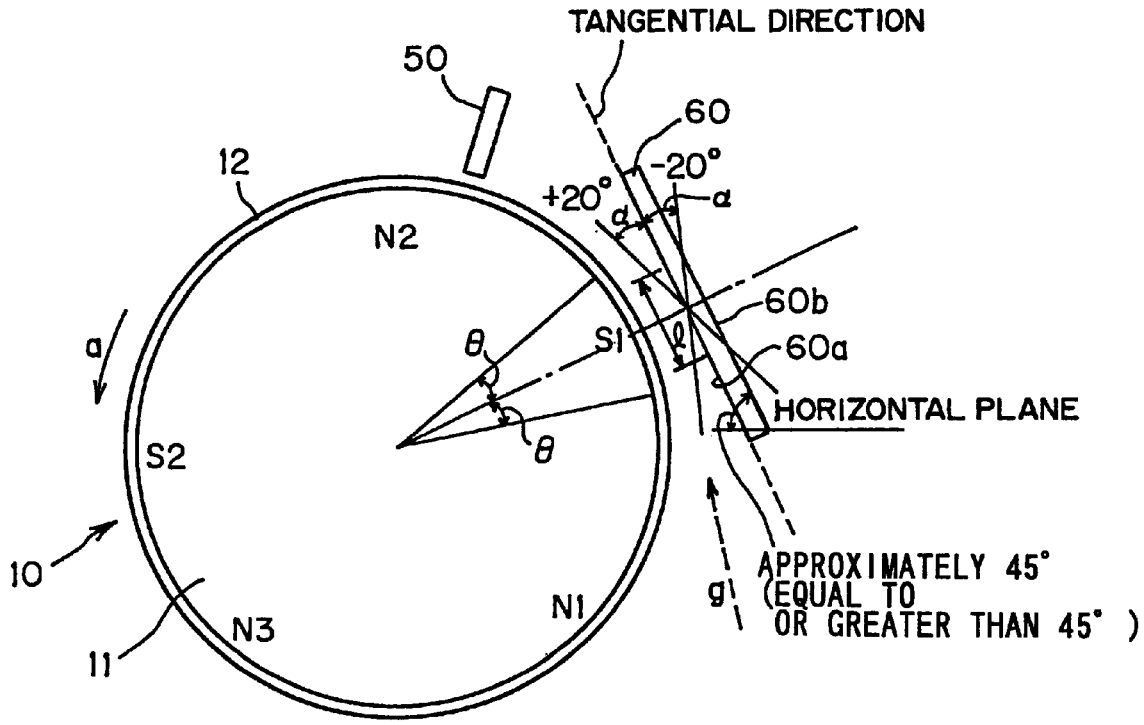
FIG. 2 is a schematic side elevational view illustrating a location of an aggregated toner dispersion member with respect to a developing roller of the developing apparatus of FIG. 1.
Figure 3:
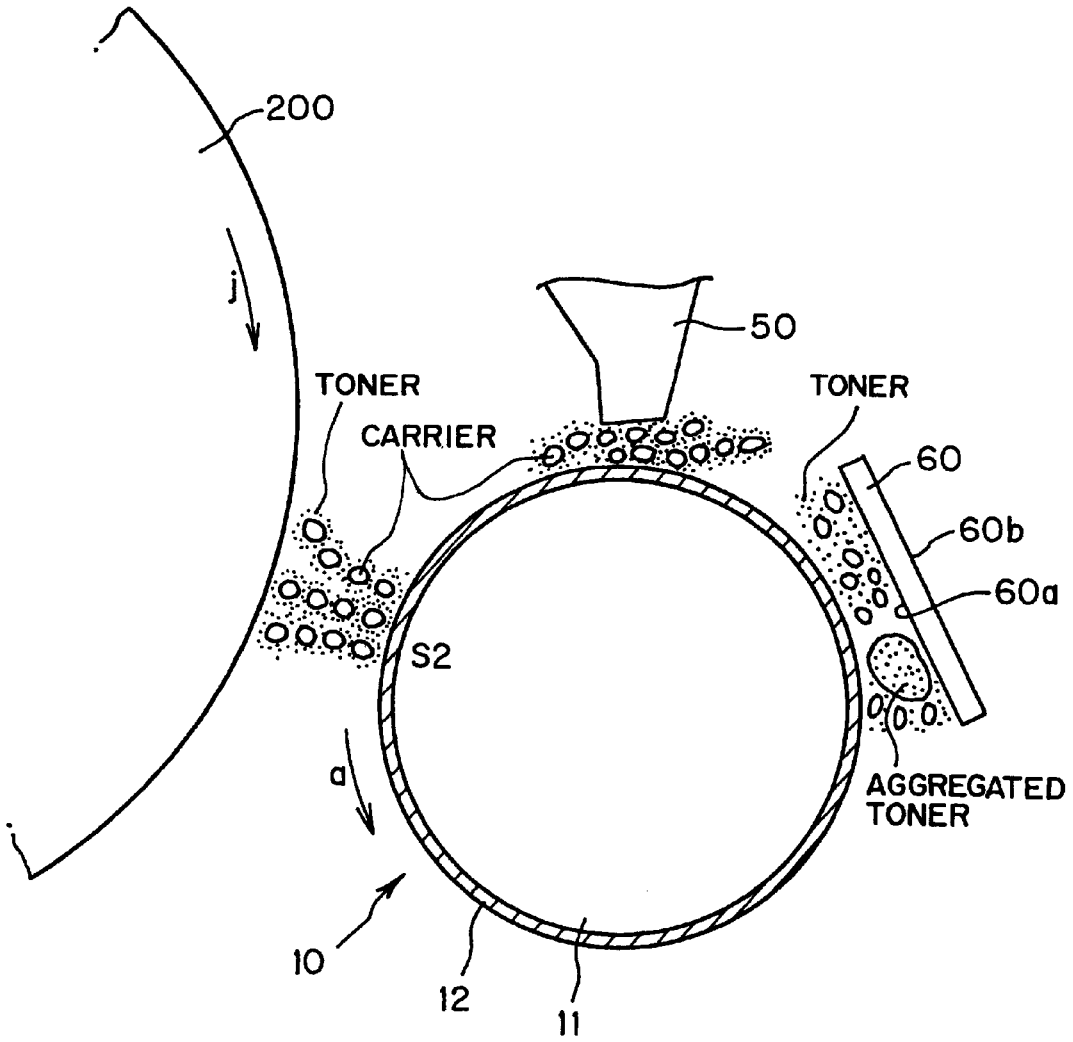
FIG. 3 is a schematic side elevational view illustrating an operation of a developer control member and the aggregated toner dispersion member of the developing apparatus of FIG. 1.

Referring first to FIGS. 1 to 3, there is shown a developing apparatus according to a first preferred embodiment of the present invention. The developing apparatus shown is denoted at developing apparatus 100 and is applied, for example, to a printing apparatus of electrophotography such that it develops an image of a photosensitive drum (image carrier) 200 with two-component developer composed of toner powder and carrier (magnetic powder). To this end, the developing apparatus 100 includes a developing roller 10, a pair of agitating and transporting screws 20 and 21, a housing 30, a toner hopper 40, a developer control member 50 and an aggregated toner dispersion member 60 as seen in FIG. 1.

Referring to FIGS. 1 and 2, the developing roller 10 includes a fixed magnet 11 in the form of a shaft having transport magnetic poles S1, S2, N1, N2 and N3, and a rotary sleeve 12 in the form of a hollow tube made of a non-magnetic material such as an aluminum alloy. The rotary sleeve 12 is fitted for rotation around the fixed magnet 11.

The transport magnetic pole N1 of the fixed magnet 11 functions to draw up developer, and the transport magnetic poles S1, N2 and N3 function to transport the developer while the transport magnetic pole S2 functions to effect development.

While the fixed magnet 11 is fixed, the rotary sleeve 12 is driven by a drive system not shown to rotate in a direction (direction indicated by an arrow mark a in FIG. 1) in which it is accompanied by the photosensitive drum 200 when the photosensitive drum 200 is rotated in a direction (direction indicated by an arrow mark j in FIG. 1).

Consequently, the developing roller 10 first attracts the developer from the agitating and transporting screw 20 to an outer circumferential face of the rotary sleeve 12 making use of magnetic force of the transport magnetic pole N1 and then transports the developer to a developing region 210, in which development of the photosensitive drum 200 is to be performed, between the photosensitive drum 200 and the developing roller 10 while the developer is kept on the outer circumferential face of the rotary sleeve 12 making use of magnetic force of the transport magnetic poles S1, N2 and S2. Then, in the developing or printing region 210, a crest of the developer is formed by magnetic force of the transport magnetic pole S2 as seen in FIG. 3, and development of the photosensitive drum 200 is performed with the developer.

The developing roller 10 is disposed adjacent and extends in parallel to the photosensitive drum 200. Further, the developing roller 10 is disposed adjacent to the agitating and transporting screw 20 on the upstream side with respect to the position of the photosensitive drum 200 around the developing roller 10 such that it receives developer agitated and mixed by the agitating and transporting screws 20 and 21 from the agitating and transporting screw 20.

The developer control member 50 is a member in the form of a plate disposed on the upstream side with respect to the position of the developing region 210 of the photosensitive drum 200 around the developing roller 10 but on the downstream side with respect to the developer receiving position from the agitating and transporting screw 20 such that it extends in parallel to the developing roller 10 over an overall extent of the developing roller 10 with a predetermined gap left from the developing roller 10. The developer control member 50 acts to control the amount of developer on the outer circumferential face of the developing roller 10 to a fixed amount and rectify the developer.

The aggregated toner dispersion member 60 is a member in the form of a plate disposed on the upstream side with respect to the position of the developer control member 50 around the outer circumferential face of the developing roller 10 but on the downstream side with respect to the position of the agitating and transporting screw 20 around the outer circumferential face of the developing roller 10 with a predetermined gap left from the outer circumferential face of the developing roller 10. The aggregated toner dispersion member 60 is formed such that at least a face (contact face) 60*a* thereof which opposes to the outer circumferential face of the developing roller 10 is a flat face. Thus, aggregated toner powder in the developer held on the outer circumferential face of the developing roller 10 is contacted under pressure with the contact face 60*a* so that it may be dispersed as seen from FIG. 3.

More particularly, the aggregated toner dispersion member 60 is disposed in an opposing relationship to the transport magnetic pole S1 of the fixed magnet 11 such that, as shown in FIG. 2, the angle $\alpha$ defined between the contact face 60*a* thereof and the tangential direction to the developing roller 10 at the position of the transport magnetic pole S1 of the fixed magnet 11 may be a predetermined angle such as, for example, $-20° \leqq \alpha \leqq 20°$. It is to be noted that, if the angle $\alpha$ defined between the contact face 60*a* of the aggregated toner dispersion member 60 and the tangential direction to the developing roller 10 (rotary sleeve 12) is greater than the angular range mentioned above, then the minimum distance between the rotary sleeve 12 and the contact face 60*a* of the aggregated toner dispersion member 60 and a margin of the contact face 60*a* of the aggregated toner dispersion member 60 from a magnetic pole peak position of the transport magnetic pole S1 of the fixed magnet 11 become smaller as much, and therefore, adjustment with regard to the dimensions is required for setting of the angle $\alpha$.

Furthermore, the aggregated toner dispersion member 60 is disposed such that a face (back face) 60*b* thereof opposite to the contact face 60*a* is inclined approximately by 45° with respect to a horizontal plane so that developer may not accumulate on the back face 60*b* of the aggregated toner dispersion member 60.

It is to be noted that, while, in the present embodiment, the angle $\alpha$ defined between the contact face 60*a* of the aggregated toner dispersion member 60 and the tangential direction to the developing roller 10 is set to $-20° \leqq \alpha \leqq 20°$, it is not limited to the specific angular range and may have any value without departing from the scope and spirit of the present invention.

Further, while, in the first embodiment, the aggregated toner dispersion member 60 is disposed such that the back face 60*b* thereof is inclined approximately by 45° with respect to a horizontal plane, the inclination angle is not limited to the specific value and may have any value if the aggregated toner dispersion member 60 is constructed so that developer may not accumulate on the back face 60*b* thereof.

Besides, the aggregated toner dispersion member 60 is disposed such that the position thereof at which the distance between the contact face 60*a* thereof and the outer circumferential face of the developing roller 10 (rotary sleeve 12) is shortest is within a predetermined range (angle $\theta$), for example, a range of $-15° \leqq \theta \leqq 15°$, from the peak position of the transport magnetic pole S1 of the fixed magnet 11. The predetermined range (angle $\theta$) from the peak position of the transport magnetic pole S1 of the fixed magnet 11 preferably is $-10° \leqq \theta \leqq 10°$. It is to be noted that, in the first embodiment shown in FIG. 2, the aggregated toner dispersion member 60 is disposed at a position at which the angle $\theta$ is equal to 0°.

In short, the aggregated toner dispersion member 60 is constructed such that developer attracted to and transported by the outer circumferential face of the rotary sleeve 12 of the developing roller 10 is contacted under pressure with the contact face 60*a* of the aggregated toner dispersion member 60 when the developer forms a crest at the position on the transport magnetic pole S1.

Consequently, force of the carrier of the developer exerted by the magnetic force of the transport magnetic pole S1 to form a crest when the developer is brought into contact with the contact face 60*a* of the aggregated toner dispersion member 60 as seen in FIG. 3 can be utilized as impact force for pressing the developer against the contact face 60*a*. Further, aggregated toner powder at a lower layer portion of the developer layer formed on the outer circumferential face of the rotary sleeve 12 can be dispersed as a crest is formed at the position at which the distance between the aggregated toner dispersion member 60 and the rotary sleeve 12 is shortest.

Figure 4:
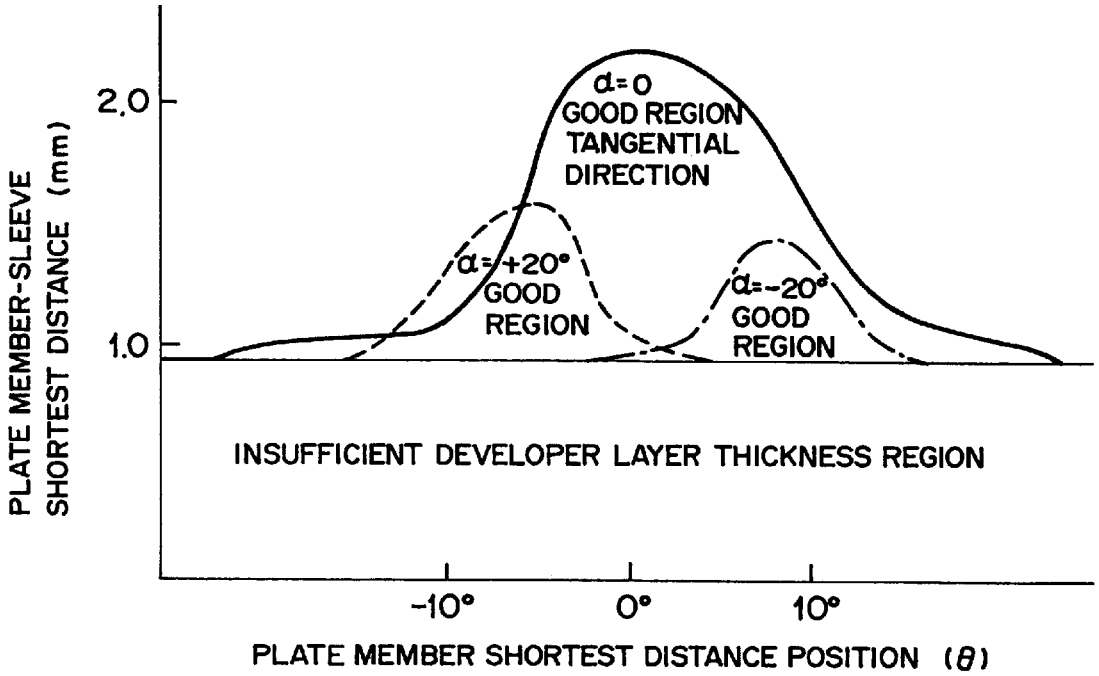
FIG. 4 is a graph illustrating a relationship among the distance between a contact face of the aggregated toner dispersion member and an outer circumferential face of the developing roller of the developing apparatus of FIG. 1, a range of a transport magnetic pole of a fixed magnet of the developing roller from a peak position, and an angle defined by the contact face of the aggregated toner dispersion member and a tangential direction of the developing roller.

FIG. 4 is a graph illustrating a relationship among the distance between the contact face 60*a* of the aggregated toner dispersion member 60 and the outer circumferential face of the developing roller 10 of the developing apparatus 100 of the first embodiment described above, the range (angle $\theta$) from the peak position of the transport magnetic pole S1 of the fixed magnet 11, and the angle ($\alpha$) defined between the contact face 60*a* of the aggregated toner dispersion member 60 and the tangential direction to the developing roller 10 at the position of the transport magnetic pole S1 of the fixed magnet 11.

It is to be noted that the graph of FIG. 4 is obtained under the following conditions. In particular, the outer diameter of the rotary sleeve 12 of the developing roller 10 is 30 mm, the peak value of the magnetic flux density of the transport magnetic pole N1 is 500 gauss, and the peak value of the magnetic flux density of the transport magnetic pole S1 is 680 gauss. Further, magnetic powder of magnetite having an average particle size of approximately 100 $\mu$m is used for the carrier and styrene-acrylic toner powder of an average particle size of approximately 10 $\mu$m to which hydrophobic silica of an average particle size of approximately 200 nm is added by 1 percent by weight is used for the toner powder, and a two-component developer obtained by mixing the styrene-acrylic toner powder by 3 percent by weight in the carrier is used for the developer. Further, the shortest distance between the outer circumferential face of the rotary sleeve 12 and the contact face 60*a* of the aggregated toner dispersion member 60 is 1.00 mm, and the plate thickness of the aggregated toner dispersion member 60 is 2.0 mm.

From FIG. 4, it can be seen that, if, under the conditions described above, $\alpha=0°$, i.e., the contact face 60*a* is in parallel to the tangential direction to the developing roller 10 at the position of the transport magnetic pole S1 of the fixed magnet 11, then where the aggregated toner dispersion member 60 is positioned such that the distance between the contact face 60*a* thereof and the outer circumferential face of the developing roller 10 is smaller than approximately 0.9 mm, the thickness of a resulting developer layer becomes insufficient and a necessary and sufficient amount of developer is not supplied to the downstream side with respect to the developer control member 50, resulting in insufficient development, and where the range (angle θ) from the peak position of the transport magnetic pole S1 of the fixed magnet 11 is $-10° \leqq \theta \leqq 10°$, dispersion of aggregated toner powder is performed effectively by the contact face 60*a* of the aggregated toner dispersion member 60, resulting in achievement of sufficient development. Further, it can be seen that, particularly where $\theta=0°$, the degree of freedom with regard to the distance between the contact face 60*a* of the aggregated toner dispersion member 60 and the outer circumferential face of the developing roller 10 is maximum and the degree of freedom in designing is highest.

Further, it can be seen that, if the angle α defined between the contact face 60*a* of the aggregated toner dispersion member 60 and the tangential direction to the developing roller 10 at the position of the transport magnetic pole S1 of the fixed magnet 11 is set to 20° or −20°, then the range of the distance between the contact face 60*a* of the aggregated toner dispersion member 60 and the outer circumferential face of the developing roller 10 within which good development can be achieved is reduced.

Further, the aggregated toner dispersion member 60 is disposed such that developer contacts with the contact face 60*a* thereof only in a predetermined region (for example, a region from a dimension equal to the distance between the rotary sleeve 12 and the developer control member 50 to another dimension greater by approximately 1 mm than the distance). This raises the aggregation density of the developer, and consequently, aggregated toner powder in the developer can be dispersed effectively.

The predetermined region of the contact face 60*a* of the aggregated toner dispersion member 60 is restricted to some degree by the distance between the rotary sleeve 12 of the developing roller 10 and the photosensitive drum 200 and the distance between the rotary sleeve 12 and the developer control member 50 for forming a developer layer of a thickness optimum to the first-mentioned distance on the rotary sleeve 12.

Further, where the developer contacts only with the predetermined region of the aggregated toner dispersion member 60 described above, no influence of the same is had on rectification of the developer by the aggregated toner dispersion member 60 on the downstream side.

It is to be noted that the optimum distance between the rotary sleeve 12 of the developing roller 10 and the aggregated toner dispersion member 60 depends upon the aggregation property of the toner powder, the diameter of the developing roller 10, the type of the carrier, the magnetic pole performance of the developing roller 10 and so forth.

It is to be noted that, while, in the present embodiment, the angle θ defined between the position at which the distance between the contact face 60*a* of the aggregated toner dispersion member 60 and the outer circumferential face of the developing roller 10 is shortest and the peak position of the transport magnetic pole S1 of the fixed magnet 11 of the developing roller 10 is within the range of $-15° \leqq \theta \leqq 15°$, the angle is not limited to a value of the specific range mentioned, but may be any value without departing from the spirit and scope of the present invention.

Further, while the magnetic flux density of the transport magnetic pole S1 at the position at which the aggregated toner dispersion member 60 is located is preferably higher than 600 gauss at the peak value, the transport magnetic pole S1 suitably has approximately 400 to 1,200 gauss taking the transport performance for developer and relations to the other transport magnetic poles N1, N2, N3 and S2 into consideration. Further, upon construction of the developing roller 10, since the pressure (developer pressure) exerted in the developer when the developer passes between the aggregated toner dispersion member 60 and the outer circumferential face of the developing roller 10 depends upon the drawn up amount of the developer by the transport magnetic pole N1, also setting of the magnetic force of the transport magnetic pole N1 to be used to draw the developer is important in order to determine the magnetic flux densities of the transport magnetic poles N1, N2, N3, S1 and S2.

It is to be noted that the face (back face) 60*b* of the aggregated toner dispersion member 60 opposite to the contact face 60*a* is preferably formed so as to prevent accumulation of developer thereon, and to this end, in the embodiment described above, the aggregated toner dispersion member 60 in the form of a plate is disposed in an inclined relationship by approximately 45° from a horizontal plane. However, the countermeasure for preventing accumulation of developer on the back face 60*b* of the aggregated toner dispersion member 60 is not limited to the specific construction described above, but may have various forms without departing from the spirit and scope of the present invention. For example, an interception member for preventing such accumulation of developer may be located, or the back face 60*b* of the aggregated toner dispersion member 60 may be formed with a low coefficient of friction.

Further, the aggregated toner dispersion member 60 is made of a non-magnetic and conductive material in order to prevent sticking thereto of carrier in the form of magnetic powder, and in order to prevent sticking of toner powder to the aggregated toner dispersion member 60, a developing bias voltage of a polarity same as that of the toner powder is applied to the aggregated toner dispersion member 60. More particularly, the aggregated toner dispersion member 60 is made of a non-magnetic metal material such as aluminum, bronze, or an SUS303 material, a conductive resin material or some other suitable material. Furthermore, the aggregated toner dispersion member 60 is preferably made of a material having such a sufficiently high strength against a pressure exerted by developer being transported as to prevent deflection of the aggregated toner dispersion member 60. However, the aggregated toner dispersion member 60 may not be made of a material of the type mentioned, but alternatively may be reinforced by a reinforcing member or a like member to assure a sufficient strength.

The toner hopper 40 supplies toner powder into the developing apparatus 100 under the control of a control section not shown. The control section calculates an amount of toner powder consumed by printing from a result of detection of a toner density sensor (not shown), a printing density sensor (not shown) or a like element and controls the toner hopper 40 so that an amount of toner powder corresponding to the consumed amount may be supplemented into the developing apparatus 100.

The housing 30 is formed such that it surrounds the developing roller 10, agitating and transporting screws 20 and 21, developer control member 50, aggregated toner dispersion member 60 and the developer (toner powder and carrier) described above, and has, on an inner side thereof, an inclined wall extending from a floor below the developing roller 10 to a floor below the agitating and transporting screw 20 such that it has a down slope toward the agitating and transporting screw 20 side. The toner hopper 40 is removably mounted on a top wall of the housing 30 above the agitating and transporting screw 21.

The photosensitive drum 200, developing roller 10, agitating and transporting screws 20 and 21, and toner hopper 40 are controlled by the control section not shown.

Now, operation of the developing apparatus 100 of the first embodiment of the present invention having the construction described above is described with reference to arrow marks of FIG. 1 and FIG. 3.

First, as indicated by a broken line arrow mark f, toner powder is supplied from the toner hopper onto the agitating and transporting screw 21 of the developing apparatus 100.

Then, the agitating and transporting screw 20 is rotated in a direction indicated by an arrow mark c while the agitating and transporting screw 21 is rotated in the direction indicated by an arrow mark d to agitate and mix the toner powder supplied thereto with carrier (developer) in the housing 30 and transport them as two-component developer. The developer is attracted from the agitating and transporting screw 20 to the outer circumferential face of the rotary sleeve 12 of the developing roller 10 at the position of the transport magnetic pole N1 of the fixed magnet 11 of the developing roller 10.

The developer attracted to the outer circumferential face of the developing roller 10 is transported in a direction indicated by a broken line arrow mark g as the rotary sleeve 12 is rotated in the direction indicated by an arrow mark a while it remains attracted to the outer circumferential face of the developing roller 10 by the magnetic force of the transport magnetic pole S1 of the fixed magnet 11, and is supplied to a location between the aggregated toner dispersion member 60 and the rotary sleeve 12. Then, the developer is contacted under pressure with the contact face 60*a* of the aggregated toner dispersion member 60 between the aggregated toner dispersion member 60 and the rotary sleeve 12. If the thus contacted developer includes aggregated toner powder therein, then the aggregated toner powder is crushed as seen in FIG. 3 since the density of the developer rises under the pressure. Consequently, such aggregated toner powder in the developer as described above can be dispersed.

In this instance, a crest of the developer is formed by the magnetic force of the transport magnetic pole S1 of the fixed magnet 11. Thereupon, the force acting to form the crest acts as impact force to press the aggregated toner powder against the contact face 60*a* and also acts to disperse aggregated toner powder in a lower layer portion of the developer.

Then, the developer whose aggregated toner powder has been dispersed is transported by the rotary sleeve 12 as the rotary sleeve 12 is rotated while the developer is attracted to the rotary sleeve 12 now by the magnetic force of the transport magnetic pole N2 of the fixed magnet 11, and is then controlled to a predetermined developer layer thickness by the developer control member 50 as seen in FIG. 3.

As the rotary sleeve 12 is rotated further, the developer is transported into the developing region 210, in which a crest of the developer is formed by the magnetic force of the transport magnetic pole S2 of the fixed magnet 11.

A free end portion of the crest of the developer remote from the rotary sleeve 12 is brought into contact with the outer circumferential face of the photosensitive drum 200, and only the toner powder in the developer is attracted to an electrostatic latent image formed on the outer circumferential face of the photosensitive drum 200 thereby to develop the electrostatic latent image.

The developer (carrier) from which the toner powder has been delivered to the photosensitive drum 200 is transported by the rotary sleeve 12 while it is attracted to the rotary sleeve 12 by the magnetic force of the transport magnetic pole N3 of the fixed magnet 11 until it comes to a position on the downstream side with respect to the transport magnetic pole N3, at which it is released from the transport magnetic pole N3. Consequently, the developer (carrier) drops onto the bottom of the housing 30 and then moves along the bottom of the housing 30 as indicted by a broken line arrow mark h in FIG. 1. Then, the developer (carrier) is agitated with toner powder supplied from the toner hopper 40 by the agitating and transporting screws 20 and 21 so that it is used for development of the photosensitive drum 200 again.

In this manner, with the developing apparatus 100 of the first embodiment of the present invention, since the aggregated toner dispersion member 60 in the form of a plate is disposed in a predetermined spaced relationship from the outer circumferential face of the developing roller 10, aggregated toner powder in developer is contacted under pressure with the aggregated toner dispersion member 60 and crushed as a result of a rise of the density of the developer. Consequently, aggregated toner powder in developer held on the outer periphery of the developing roller 10 can be contacted under pressure with and dispersed by the contact face 60*a*, and such aggregated toner powder is prevented from coming to the photosensitive drum 200. Consequently, the quality of a resulting print can be augmented.

Further, since aggregated toner powder is dispersed by the aggregated toner dispersion member 60 on the upstream side with respect to the position of the developer control member 50 along the outer circumferential face of the developing roller 10, a developer layer on the outer circumferential face of the developer control member 50 which has been arranged by the developer control member 50 is not disturbed, and consequently, the print quality can be augmented.

Furthermore, since the aggregated toner dispersion member 60 is disposed in an opposing relationship to the transport magnetic pole S1 such that the angle a defined between the contact face 60*a* thereof and the tangential direction to the developing roller 10 at the position of the transport magnetic pole S1 of the fixed magnet 11 may be a predetermined angle (for example, $-20° \leqq \alpha \leqq 20°$), aggregated toner powder can be dispersed with certainty.

Further, since the aggregated toner dispersion member 60 is constructed such that the position at which the distance between the contact face 60*a* thereof and the outer circumferential face of the developing roller 10 (rotary sleeve 12) is shortest may be within a predetermined range (angle $\theta$) (for example, $-15° \leqq \theta \leqq 15°$) from the peak position of the transport magnetic pole S1 of the fixed magnet 11, force exerted by the magnetic force of the transport magnetic pole S1 of the fixed magnet 11 to form a crest of the developer between the aggregated toner dispersion member 60 and the rotary sleeve 12 acts as impact force to contact the aggregated toner powder under pressure with the aggregated toner dispersion member 60 and also aggregated toner powder in a lower layer portion of the developer on the outer periphery of the rotary sleeve 12 is dispersed. Consequently, any aggregated toner powder can be dispersed effectively.

Furthermore, since the aggregated toner dispersion member 60 is made of a non-magnetic material, sticking of carrier in the form of magnetic powder to the aggregated toner dispersion member 60 can be prevented. Further, since the aggregated toner dispersion member 60 is made of a conductive material and a developing bias voltage of a polarity same as that of toner powder is applied to the aggregated toner dispersion member 60, sticking of toner powder to the aggregated toner dispersion member 60 can be prevented similarly. As a result, developer does not stick to the aggregated toner dispersion member 60 at all and the quality of developer can be maintained, and aggregated toner powder can be dispersed with certainty.

Further, since the aggregated toner dispersion member 60 is disposed such that the face (back face) 60*b* of the aggregated toner dispersion member 60 opposite to the contact face 60*a* is inclined by approximately 45° from a horizontal plane so that developer may not accumulate on the back face 60*b* of the aggregated toner dispersion member 60, the amount of developer in the developing apparatus 100 can be maintained fixed, and the print quality can be maintained.

Furthermore, since the aggregated toner dispersion member 60 is formed from a member in the form of a plate and aggregated toner powder can be dispersed readily by the aggregated toner dispersion member 60, the mechanism for dispersing aggregated toner powder in the developing apparatus 100 can be formed in a simplified structure economically.

Further, since the burden imposed for prevention of aggregation of toner powder by addition of an additive is reduced, the degree of freedom in designing toner powder increases.

B. Second Embodiment

Figure 5:
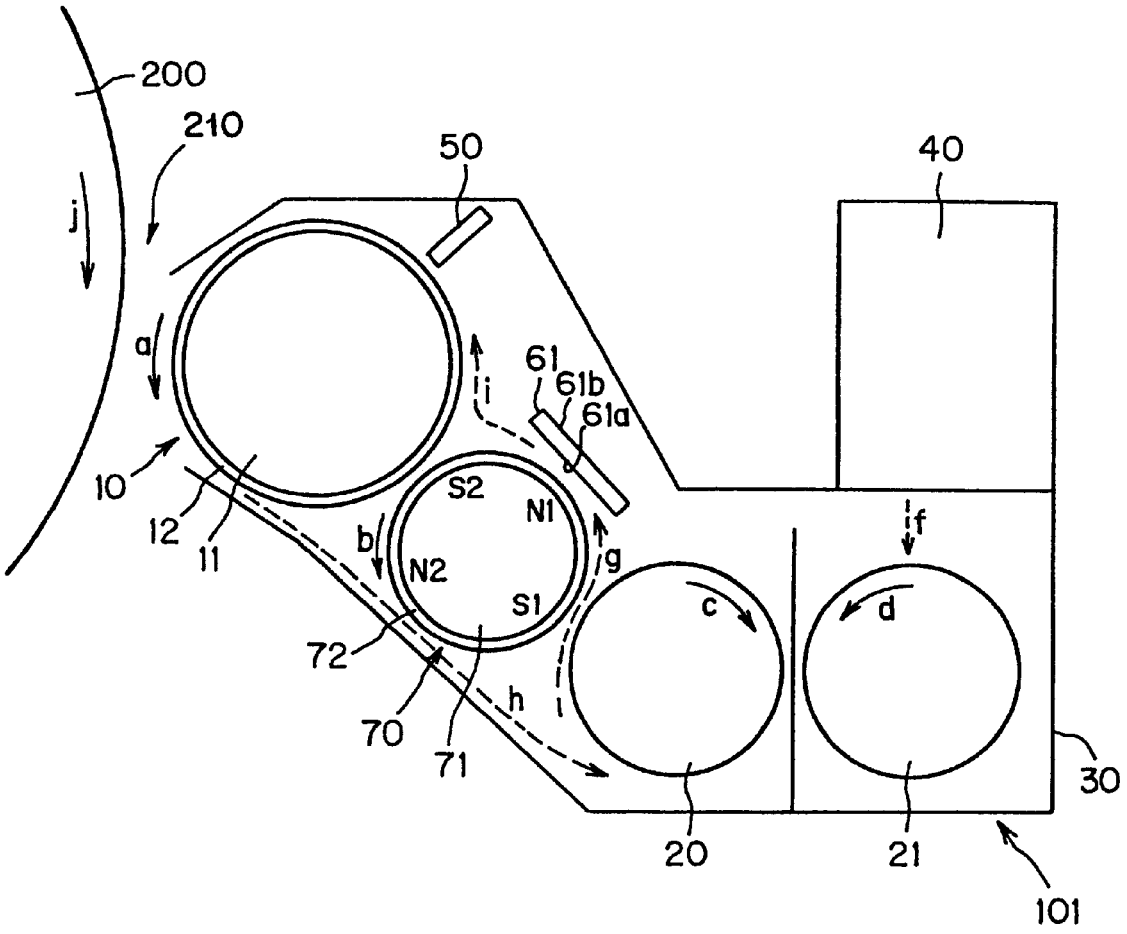
FIG. 5 is a side elevational view schematically showing a construction of a developing apparatus according to a second preferred embodiment of the present invention.
Figure 6:
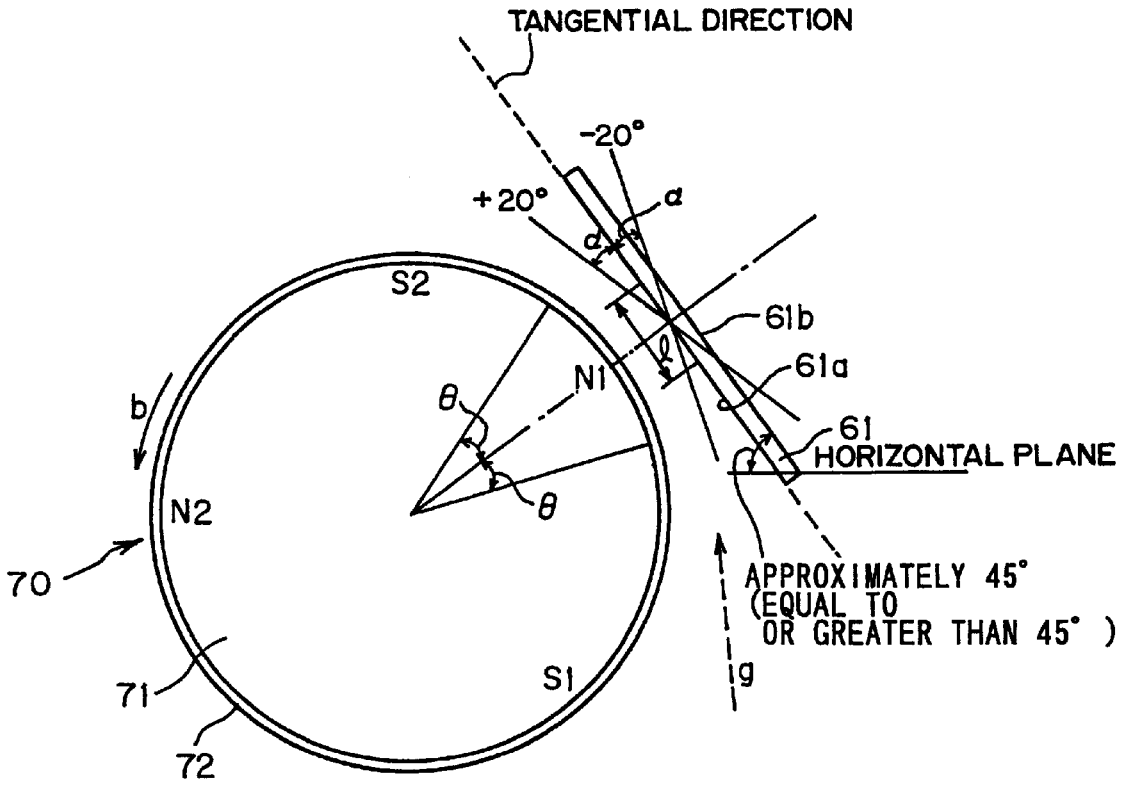
FIG. 6 is a schematic side elevational view illustrating a setting position of an aggregated toner dispersion member with respect to a transport roller of the developing apparatus of FIG. 5.

FIGS. 5 and 6 show a developing apparatus according to a second preferred embodiment of the present invention.

Referring first to FIG. 5, the developing apparatus 101 of the present embodiment is a modification to but is different from the developing apparatus 100 of the first embodiment described hereinabove in that a transport roller 70 is located between the developing roller 10 and the agitating and transporting screw 20. More particularly, the developing apparatus 101 includes a developing roller 10, a transport roller 70, agitating and transporting screws 20 and 21, a housing 30, a toner hopper 40, a developer control member 50 and a aggregated toner dispersion member 61.

The transport roller 70 is disposed in the proximity of and on the downstream side with respect to the agitating and transporting screw 20 and in the proximity of and on the upstream side with respect to the developing roller 10 and extends in parallel to the developing roller 10 and the agitating and transporting screws 20 and 21. The transport roller 70 includes a fixed magnet 71 in the form of a shaft having transport magnetic poles S1, S2, N1 and N2, and a rotary sleeve 72 in the form of a hollow tube made of a non-magnetic material such as an aluminum alloy. The rotary sleeve 72 is fitted for rotation on the fixed magnet 71.

The transport magnetic pole S1 of the fixed magnet 71 functions to draw up developer, and the transport magnetic poles N1, N2 and S2 function to transport developer.

The rotary sleeve 72 is driven to rotate in a direction indicted by an arrow mark b in FIG. 5 by a drive system not shown while the fixed magnet 71 is fixed.

Thus, the transport roller 70 attracts developer from the agitating and transporting screw 20 to an outer circumferential face of the rotary sleeve 72 making use of magnetic force of the transport magnetic pole S1 and then transports the developer held on the outer circumferential face of the rotary sleeve 72 to a position in the proximity of the developing roller 10 making use of magnetic force of the transport magnetic poles N1, S2 and N2.

While, in the first embodiment described hereinabove, the aggregated toner dispersion member 60 is provided in the proximity of the outer periphery of the developing roller 10, in the developing apparatus 101 of the present embodiment, the aggregated toner dispersion member 61 which has a similar function to that of the aggregated toner dispersion member 60 is mounted in the proximity of the outer periphery of the transport roller 70.

The aggregated toner dispersion member 61 is a member in the form of a plate disposed on the upstream side with respect to a position at which the developing roller 10 is nearest to the outer circumferential face of the transport roller 70 but on the downstream side with respect to the position of the agitating and transporting screw 20 in a predetermined spaced relationship from the outer circumferential face of the transport roller 70. The transport roller 70 is formed such that at least a face (contact face) 61*a* thereof which opposes the outer circumferential face of the transport roller 70 is formed as a flat face, and aggregated toner powder in developer held on the outer circumferential face of the transport roller 70 is contacted under pressure with the contact face 61*a* so that it may be dispersed.

Referring now to FIG. 6, the aggregated toner dispersion member 61 is disposed in an opposing relationship to the transport magnetic pole N1 of the fixed magnet 71 such that the angle $\alpha$ defined between the contact face 61*a* thereof and the tangential direction to the transport roller 70 at the position of the transport magnetic pole N1 of the fixed magnet 71 may be a predetermined angle such as, for example, $-20° \leqq \alpha \leqq 20°$. It is to be noted that, if the angle a defined between the contact face 61*a* of the aggregated toner dispersion member 61 and a tangential direction to the transport roller 70 (rotary sleeve 72) is greater than the angular range mentioned above, then the minimum distance between the rotary sleeve 72 and the contact face 61*a* of the aggregated toner dispersion member 61 and a margin of the contact face 61*a* of the aggregated toner dispersion member 61 from a magnetic pole peak position of the transport magnetic pole N1 of the fixed magnet 71 become smaller as much, and therefore, adjustment with regard to the dimensions is required for setting of the angle $\alpha$.

Furthermore, the aggregated toner dispersion member 61 is disposed such that a face (back face) 61*b* thereof opposite to the contact face 61*a* is inclined approximately by 45° with respect to a horizontal plane so that developer may not accumulate on the back face 61*b* of the aggregated toner dispersion member 61.

It is to be noted that, while, in the present embodiment, the angle $\alpha$ defined between the contact face 61*a* of the aggregated toner dispersion member 61 and the tangential direction to the transport roller 70 at the position of the transport magnetic pole N1 of the fixed magnet 71 is set to $-20° \leqq \alpha \leqq 20°$, it is not limited to the specific angular range and may have any value without departing from the scope and spirit of the present invention.

Further, while, in the second embodiment, the aggregated toner dispersion member 61 is disposed such that the back face 61*b* thereof is inclined approximately by 45° with respect to a horizontal plane, the inclination angle is not limited to the specific value and may have any value if the aggregated toner dispersion member 61 is constructed so that developer may not accumulate on the back face 61*b* thereof.

Besides, the aggregated toner dispersion member 61 is disposed such that the position thereof at which the distance between the contact face 61*a* thereof and the outer circumferential face of the transport roller 70 (rotary sleeve 72) is shortest is within a predetermined range (angle $\theta$), for example, a range of $-15° \leqq \theta \leqq 15°$, from the peak position of the transport magnetic pole N1 of the fixed magnet 71. The predetermined range (angle θ) from the peak position of the transport magnetic pole N1 of the fixed magnet 71 preferably is $-10° \leqq \theta \leqq 10°$. It is to be noted that, in the second embodiment shown in FIG. 6, the aggregated toner dispersion member 61 is disposed at a position at which the angle θ is equal to 0°.

In short, the aggregated toner dispersion member 61 is constructed such that developer attracted to and transported by the outer circumferential face of the rotary sleeve 72 of the transport roller 70 is contacted under pressure with the contact face 61*a* of the aggregated toner dispersion member 61 when the developer forms a crest at the position on the transport magnetic pole N1.

Consequently, force of the carrier of the developer exerted by the magnetic force of the transport magnetic pole N1 to form a crest when the developer is brought into contact with the contact face 61*a* of the aggregated toner dispersion member 61 can be utilized as impact force for pressing the developer against the contact face 61*a*. Further, aggregated toner powder at a lower layer portion of the developer layer formed on the outer circumferential face of the rotary sleeve 72 can be dispersed as a crest is formed at the position at which the distance between the aggregated toner dispersion member 61 and the rotary sleeve 72 is shortest.

Figure 7:
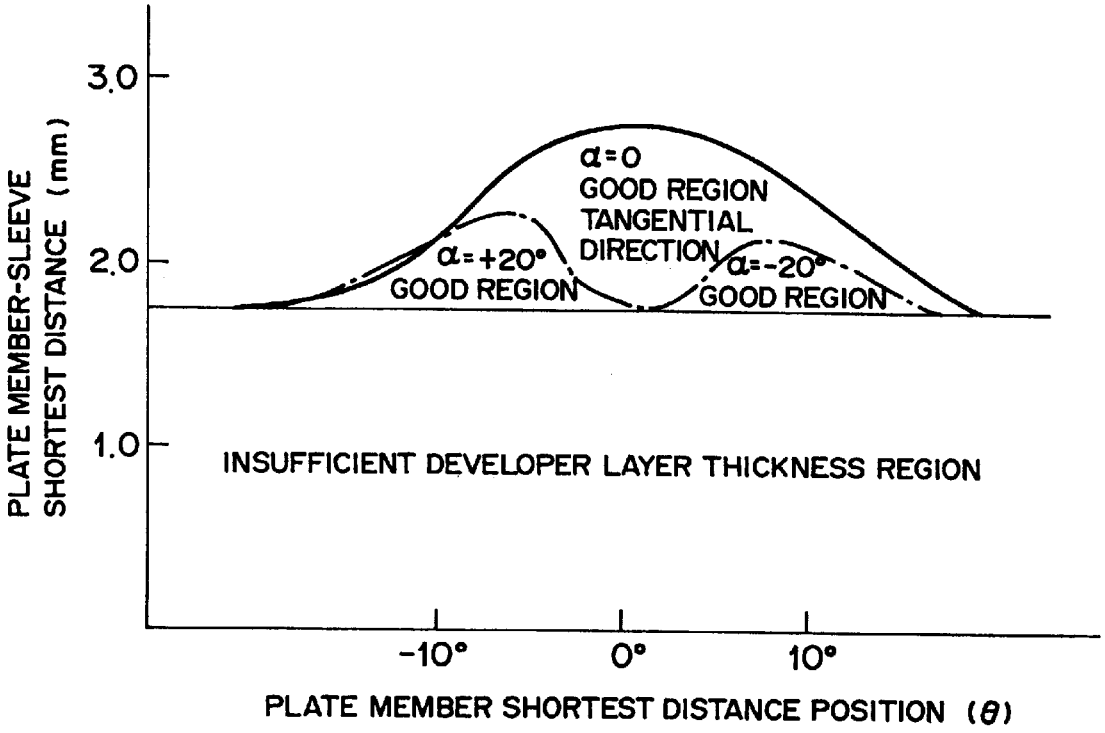
FIG. 7 is a graph illustrating a relationship among the distance between a contact face of the aggregated toner dispersion member and an outer circumferential face of a developing roller of the developing apparatus of FIG. 5, a range of a transport magnetic pole of a fixed magnet of the developing roller from a peak position, and an angle defined by the contact face of the aggregated toner dispersion member and a tangential direction of the developing roller.

FIG. 7 is a graph illustrating a relationship among the distance between the contact face 61*a* of the aggregated toner dispersion member 61 and the outer circumferential face of the transport roller 70 of the developing apparatus 101 of the second embodiment described above, the range (angle θ) from the peak position of the transport magnetic pole N1 of the fixed magnet 71, and the angle (α) defined between the contact face 61*a* of the aggregated toner dispersion member 61 and the tangential direction to the transport roller 70 at the position of the transport magnetic pole N1 of the fixed magnet 71.

It is to be noted that the graph of FIG. 7 is obtained under the following conditions. In particular, the outer diameter of the rotary sleeve 72 of the transport roller 70 is 26 mm, the peak value of the magnetic flux density of the transport magnetic pole S1 is 550 gauss, and the peak value of the magnetic flux density of the transport magnetic pole N1 is 750 gauss. Further, magnetic powder of magnetite having an average particle size of approximately 100 μm is used for the carrier and styrene-acrylic toner powder of an average particle size of approximately 10 μm to which hydrophobic silica of an average particle size of approximately photosensitive drum 200 nm is added by 1 percent by weight is used for the toner powder, and a two-component developer obtained by mixing the styrene-acrylic toner powder by 3 percent by weight in the carrier is used for the developer. Further, the shortest distance between the outer circumferential face of the rotary sleeve 72 and the outer circumferential face of the rotary sleeve 12 is 3.00 mm, and the plate thickness of the aggregated toner dispersion member 61 is 2.0 mm.

From FIG. 7, it can be seen that, if, under the conditions described above, $\alpha=0°$, i.e., the contact face 61*a* is in parallel to the tangential direction to the transport roller 70 at the position of the transport magnetic pole N1 of the fixed magnet 71, then where the aggregated toner dispersion member 61 is positioned such that the distance between the contact face 61*a* thereof and the outer circumferential face of the transport roller 70 is smaller than approximately 1.7 mm, the thickness of a resulting developer layer becomes insufficient and a necessary and sufficient amount of developer is not supplied to the downstream side with respect to the developer control member 50, resulting in insufficient development, and where the range (angle θ) from the peak position of the transport magnetic pole N1 of the fixed magnet 71 is $-10° \leqq \theta \leqq 10°$, dispersion of aggregated toner powder is performed effectively by the contact face 61*a* of the aggregated toner dispersion member 61, resulting in achievement of sufficient development. Further, it can be seen that, particularly where θ=020 , the degree of freedom with regard to the distance between the contact face 61*a* of the aggregated toner dispersion member 61 and the outer circumferential face of the transport roller 70 is maximum and the degree of freedom in designing is highest.

Further, it can be seen that, if the angle a defined between the contact face 61*a* of the aggregated toner dispersion member 61 and the tangential direction to the transport roller 70 at the position of the transport magnetic pole N1 of the fixed magnet 71 is set to 20° or −20°, then the range of the distance between the contact face 61*a* of the aggregated toner dispersion member 61 and the outer circumferential face of the transport roller 70 within which good development can be achieved is reduced.

Further, the aggregated toner dispersion member 61 is disposed such that developer contacts with the contact face 61*a* thereof only in a predetermined region. Consequently, aggregated toner powder in the developer can be dispersed effectively.

It is to be noted that, since the transport roller 70 is provided in order to supply developer to the developing roller 10, the predetermined region of the contact face 61*a* of the aggregated toner dispersion member 61 is set in a different condition from that of the predetermined region of the contact face 60*a* of the aggregated toner dispersion member 60 of the developing apparatus 100 of the first embodiment, and also the optimum distance between the rotary sleeve 72 of the transport roller 70 and the aggregated toner dispersion member 61 is similarly set in a different condition to that of the distance between the developing roller 10 and the aggregated toner dispersion member 60 of the developing apparatus 100 of the first embodiment.

It is to be noted that, while, in the present embodiment, the angle θ defined between the position at which the distance between the contact face 61*a* of the aggregated toner dispersion member 61 and the outer circumferential face of the transport roller 70 is shortest and the peak position of the transport magnetic pole N1 of the fixed magnet 71 of the developing roller 70 is within the range of $-15° \leqq \theta \leqq 15°$, the angle is not limited to a value of the specific range mentioned, but may be any value without departing from the spirit and scope of the present invention.

Further, while the magnetic flux density of the transport magnetic pole N1 at the position at which the aggregated toner dispersion member 61 is located is preferably higher than 600 gauss at the peak value, the transport magnetic pole N1 suitably has approximately 400 to 1,200 gauss taking the transport performance for developer and relations to the other transport magnetic poles N2, S1 and S2 into consideration. Further, upon construction of the transport roller 70, since the pressure (developer pressure) exerted in the developer when the developer passes between the aggregated toner dispersion member 61 and the outer circumferential face of the transport roller 70 depends upon the drawn up amount of the developer by the transport magnetic pole S1, also setting of the magnetic force of the transport magnetic pole S1 to be used to draw the developer is important in order to determine the magnetic flux densities of the transport magnetic poles N1, N2 and S2.

It is to be noted that the face (back face) 61*b* of the aggregated toner dispersion member 61 opposite to the contact face 61*a* is preferably formed so as to prevent accumulation of developer thereon, and to this end, in the present embodiment described above, the aggregated toner dispersion member 61 in the form of a plate is disposed in an inclined relationship by approximately 45° from a horizontal plane. However, the countermeasure for preventing accumulation of developer on the back face 61*b* of the aggregated toner dispersion member 61 is not limited to the specific construction described above, but may have various forms without departing from the spirit and scope of the present invention. For example, an interception member for preventing such accumulation of developer on the back face 61*b* of the aggregated toner dispersion member 61 may be located, or the back face 61*b* of the aggregated toner dispersion member 61 may be formed with a low coefficient of friction.

Further, the aggregated toner dispersion member 61 is made of a non-magnetic and conductive material in order to prevent sticking thereto of carrier in the form of magnetic powder, and in order to prevent sticking of toner powder to the aggregated toner dispersion member 61, a developing bias voltage of a polarity same as that of the toner powder is applied to the aggregated toner dispersion member 61. More particularly, the aggregated toner dispersion member 61 is made of a non-magnetic metal material such as aluminum, bronze, or an SUS303 material, a conductive resin material or some other suitable material. Furthermore, the aggregated toner dispersion member 61 is preferably made of a material having such a sufficiently high strength against a pressure exerted by developer being transported as to prevent deflection of the aggregated toner dispersion member 61. However, the aggregated toner dispersion member 61 may not be made of a material of the type mentioned, but alternatively may be reinforced by a reinforcing member or a like member to assure a sufficient strength.

Now, operation of the developing apparatus 101 of the second embodiment of the present invention having the construction described above is described with reference to arrow marks of FIG. 5.

First, as indicated by a broken line arrow mark f, toner powder is supplied from the toner hopper 40 onto the agitating and transporting screw 21 of the developing apparatus 101.

Then, the agitating and transporting screw 20 is rotated in a direction indicated by an arrow mark c while the agitating and transporting screw 21 is rotated in the direction indicated by an arrow mark d to agitate and mix the toner powder supplied thereto from the toner hopper 40 with carrier (developer) in the housing 30 and transport them as two-component developer. The developer is attracted from the agitating and transporting screw 20 to the outer circumferential face of the transport sleeve 72 of the transport roller 70 at the position of the transport magnetic pole S1 of the fixed magnet 71 of the transport roller 70.

The developer attracted to the outer circumferential face of the transport roller 70 is transported in a direction indicated by a broken line arrow mark g as the rotary sleeve 72 is rotated in the direction indicated by an arrow mark b while it remains attracted to the outer circumferential face of the transport roller 70 by the magnetic force of the transport magnetic pole N1 of the fixed magnet 71, and is supplied to a location between the aggregated toner dispersion member 61 and the rotary sleeve 72. Then, the developer is contacted under pressure with the contact face 61*a* of the aggregated toner dispersion member 61 between the aggregated toner dispersion member 61 and the rotary sleeve 72. If the thus contacted developer includes aggregated toner powder therein, then the aggregated toner powder is crushed since the density of the developer rises under the pressure. Consequently, such aggregated toner powder in the developer as described above can be dispersed.

In this instance, a crest of the developer is formed by the magnetic force of the transport magnetic pole N1 of the fixed magnet 71. Thereupon, the force acting to form the crest acts as impact force to press the aggregated toner powder against the contact face 61*a* and also acts to disperse aggregated toner powder in a lower layer portion of the developer.

Then, the developer whose aggregated toner powder has been dispersed is transported by the rotary sleeve 72 as the rotary sleeve 72 is rotated while the developer is attracted to the rotary sleeve 72 now by the magnetic force of the transport magnetic pole S2 of the fixed magnet 71, and is then attracted by the magnetic force of the fixed magnet 11 of the developing roller 10 at a position in the proximity of the developing roller 10 and the transport roller 70 so that it is delivered to the outer circumferential face of the developing roller 10 as indicated by a broken line arrow mark i.

It is to be noted that, in FIG. 5, the transport magnetic poles of the fixed magnet 11 of the developing roller 10 are not shown.

The developer attracted to the outer circumferential face of the developing roller 10 is transported as the rotary sleeve 12 rotates in the direction indicated by an arrow mark a, and is controlled to a predetermined developer layer thickness by the developer control member 50.

Further, the developer is transported to the developing region 210 as the rotary sleeve 12 further rotates. In the developing region 210, the developer is brought into contact with the outer circumferential face of the photosensitive drum 200, and only the toner powder in the developer is attracted to an electrostatic latent image formed on the outer circumferential face of the photosensitive drum 200 thereby to develop the electrostatic latent image.

The developer (carrier) from which the toner powder has been delivered to the photosensitive drum 200 is transported by the rotary sleeve 12 and then released from the rotary sleeve 12. Thereafter, the developer moves along the bottom of the housing 30 as indicted by a broken line arrow mark h in FIG. 5. Then, the developer (carrier) is agitated with toner powder supplied from the toner hopper 40 by the agitating and transporting screws 20 and 21 so that it is used for development of the photosensitive drum 200 again.

In this manner, with the developing apparatus 101 of the second embodiment of the present invention, similar advantages to those described above can be achieved. Further, since developer can be transmitted from the agitating and transporting screw 20 to the developing roller 10 by the transport roller 70, the developing roller 10 need not be disposed adjacent to the agitating and transporting screw 20. Consequently, the degree of freedom in designing can be raised.

C. Modification to the Second Embodiment

Figure 8:
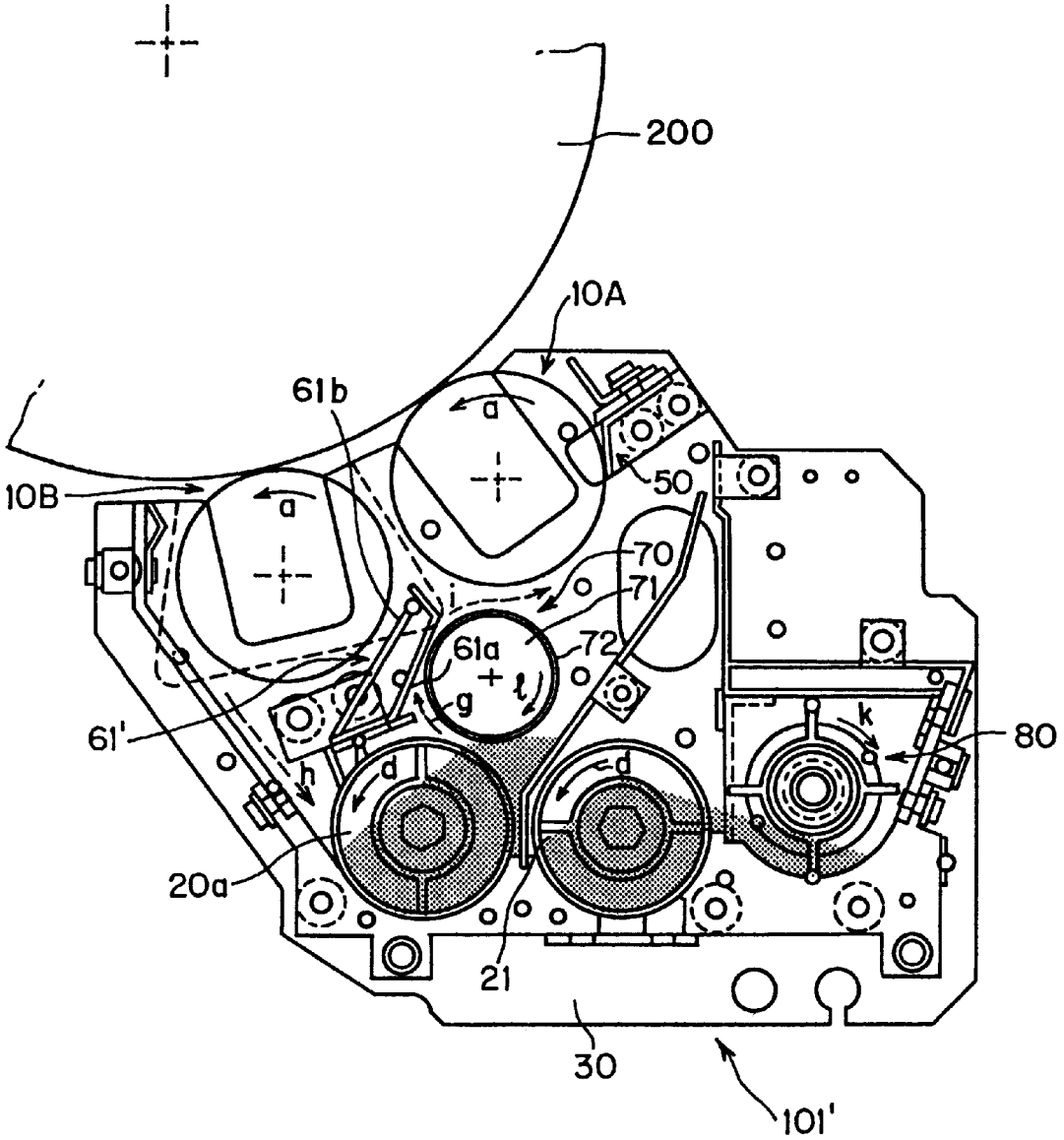
FIG. 8 is a side elevational view schematically showing a construction of a modification to the developing apparatus of FIG. 5.

FIG. 8 schematically shows a construction of a developing apparatus 101' which is a modification to the second embodiment of the present invention. Referring to FIG. 8, the modified developing apparatus 101' is different from the developing apparatus 101 of the second embodiment in the position of the transport roller 70 and the mounted position of the aggregated toner dispersion member 61 with respect to the transport roller 70 and also in that it includes a first developing roller 10A and a second developing roller 10B in place of the single developing roller 10.

Further, the developing apparatus 101' includes a toner transport screw 80 for transporting toner powder supplied thereto from the toner hopper not shown in FIG. 8 to the agitating and transporting screw 21.

A agitating and transporting screw 20*a* has a screw thread of a direction reverse to that of the agitating and transporting screw 21 formed thereon and is driven to rotate in a direction same as the direction of rotation (direction indicated by an arrow mark d in FIG. 8) of the agitating and transporting screw 21 so that it cooperates with the agitating and transporting screw 21 to agitate developer.

The developer agitated by the agitating and transporting screws 20*a* and 21 accumulates at a location between the agitating and transporting screw 20*a* and the agitating and transporting screw 21.

The transport roller 70 is disposed in parallel to the agitating and transporting screws 20*a* and 21 above an intermediate position between the agitating and transporting screw 20*a* and the agitating and transporting screw 21, and the rotary sleeve 72 of the transport roller 70 is driven to rotate in the direction indicated by an arrow mark 1 by a drive section not shown. The developer agitated by the agitating and transporting screws 20*a* and 21 and accumulating between the agitating and transporting screws 20*a* and 21 is attracted to the outer circumferential face of the rotary sleeve 72 and transported in the direction indicated by a broken line arrow mark g.

An aggregated toner dispersion member 61' is disposed in an opposing relationship to a transport magnetic pole of the fixed magnet 71 on the outer circumferential face of the transport roller 70 (on the left side of the transport roller 70 in FIG. 8). The aggregated toner dispersion member 61' has a contact face 61*a* and has a function similar to that of the aggregated toner dispersion member 61 described hereinabove with reference to FIG. 5. A member (contact face 61*b*) in the form of a plate inclined at an angle greater than 45° with respect to a horizontal plane is disposed on the opposite side to the contact face 61*a* of the aggregated toner dispersion member 61' so that developer may not accumulate on the aggregated toner dispersion member 61'.

The first developing roller 10A is disposed in the proximity of the photosensitive drum 200 above the transport roller 70, and the second developing roller 10B is disposed in the proximity of the photosensitive drum 200 and next to and in the proximity of the first developing roller 10A.

Since the developing apparatus 101' of the modification to the second embodiment of the present invention is constructed in such a manner as described above, toner powder supplied from the toner hopper not shown is first transported to the agitating and transporting screw 21 by the toner transport screw 80 and then agitated and mixed with carrier as the agitating and transporting screws 20*a* and 21 rotate in the direction indicated by the arrow mark d to form developer.

The developer is attracted to the outer circumferential face of the rotary sleeve 72 of the transport roller 70 and transported in the direction indicated by the broken line arrow mark g as the rotary sleeve 72 rotates in the direction indicted by the arrow mark 1 until it is supplied to a location between the contact face 61*a* of the aggregated toner dispersion member 61' and the rotary sleeve 72. Then, the developer is contacted under pressure with the contact face 61*a* of the aggregated toner dispersion member 61' between the aggregated toner dispersion member 61' and the rotary sleeve 72, and aggregated toner powder in the thus pressed developer is crushed as the density of the developer increases. Consequently, any aggregated toner powder in the developer can be dispersed.

Then, a crest of the developer is formed by the magnetic force of the fixed magnet 71 of the transport roller 70. The force acting to form a crest of the developer acts as impact force to press aggregated toner powder against the contact face 61*a*, and also aggregated in a lower layer portion of the developer is dispersed.

The developer whose aggregated toner powder has been dispersed is transported as the rotary sleeve 72 rotates, and is attracted by the magnetic force of a fixed magnet (not shown in FIG. 8) provided in the first developing roller 10A at a position in the proximity of the first developing roller 10A and the transport roller 70 and is transported in the direction indicated by a broken line arrow mark i. Then, the developer is delivered to the outer circumferential face of the first developing roller 10A.

It is to be noted that, in FIG. 8, the fixed magnets, rotary sleeves and so forth of the first developing roller 10A and the second developing roller 10B are omitted.

The developer attracted to the outer circumferential face of the first developing roller 10A is transported as the rotary sleeve thereof rotates in the direction of the arrow mark a and is controlled to a predetermined developer layer thickness by the developer control member 50.

Then, the developer is transported into a developing region as the rotary sleeve of the first developing roller 10A rotates, and contacts, in the developing region, with the outer circumferential face of the photosensitive drum 200. Then, only the toner powder in the developer is attracted to an electrostatic latent image formed on the outer circumferential face of the photosensitive drum 200 thereby to develop the electrostatic latent image.

Meanwhile, the developer which has been used for the development by the first developing roller 10A is attracted to the fixed magnet of the second developing roller 10B so that it is delivered to the outer circumferential face of the second developing roller 10B.

Then, the developer transported as the rotary sleeve of the second developing roller 10B rotates develops the electrostatic latent image formed on the outer circumferential face of the photosensitive drum 200 again in the developing region between the photosensitive drum 200 and the second developing roller 10B.

The developer (carrier) whose toner powder has been delivered to the photosensitive drum 200 is transported by the rotary sleeve of the second developing roller 10B and then spaced away from the rotary sleeve. Then, the developer (carrier) moves along the bottom of the housing 30 as indicated by an a broken line arrow mark h of FIG. 8 and is agitated with toner powder supplied from the toner hopper by the agitating and transporting screws 20*a* and 21 so that it is used for development of the photosensitive drum 200 again.

In this manner, with the developing apparatus 101' of the modification to the second embodiment of the present invention, similar advantages to those of the second embodiment described hereinabove can be achieved. Further, since development of an electrostatic latent image of the photosensitive drum 200 is performed by the first developing roller 10A and the second developing roller 10B, the supplied amount of developer to be used for development of the photosensitive drum 200 can be increased and the printing speed can be raised.

Since the agitating and transporting screw 21 and the agitating and transporting screw 20*a* which has a screw thread of the direction reverse to that of the agitating and transporting screw 21 formed thereon are driven to rotate in the same direction to agitate developer, the developer agitated by the agitating and transporting screws 20*a* and 21 accumulates at a position between the agitating and transporting screw 20*a* and the agitating and transporting screw 21, and consequently, the developer can be transported efficiently to the developing roller 10.

D. Others

It is to be noted that, while each of the aggregated toner dispersion members 60 and 61 in the embodiments described above is formed as a member in the form of a plate, it is not limited to a member of the specific shape, but it is required only that the contacting face thereof which opposes to the outer circumferential face of the developing roller 10 or the transport roller 70 be a flat face. For example, the aggregated toner dispersion member may be formed, for example, from a member in the form of a block. In this manner, the aggregated toner dispersion member may have any form only if the required functions are achieved.

The present invention is not limited to the embodiments specifically described above, and variations and modifications can be made without departing from the scope of the present invention.

What is claimed is:

1. A developing apparatus for applying developer, which includes toner powder and magnetic powder, over an image carrier so as to develop a latent image formed on said image carrier, comprising:

(I) a developing roller including (I-i) a fixed magnet, and (I-ii) a rotary sleeve, rotatably mounted around a circumference of said fixed magnet, said developing roller being operable to apply the developer, which is attracted to and held on an outer periphery said rotary sleeve by said fixed magnet, to a developing region of said image carrier, to develop the latent image on said image carrier;

(II) a developer control member for regulating the amount of the developer, which is held on the outer periphery of said rotary sleeve of said developing roller, in a manner such that the developer is uniformly held on the outer periphery of said rotary sleeve; and (III) an aggregated toner dispersion member, which is disposed upstream to of said developer control member, said toner dispersion member having a contact face, engageable with aggregated toner powder of the developer, which is held on the outer periphery of said rotary sleeve, for crushing the aggregated toner powder to attain dispersion;

said aggregated toner dispersion member being spaced by a predetermined distance from the outer periphery of said rotary sleeve and assuming such a posture that said contact face has an optimum angle with respect to a tangent of the outer periphery of said rotary sleeve.

2. A developing apparatus for transporting developer which includes toner powder and magnetic powder to an image carrier to perform development of said image carrier, comprising:

a developing roller including a fixed magnet having a transport magnetic pole thereon and a rotary sleeve driven to rotate around an outer periphery of said fixed magnet for holding the developer on an outer periphery of said rotary sleeve making use of a magnetic force of said fixed magnet and transporting the developer to a developing region of said image carrier so that said image carrier is developed with the developer in the developing region;

a developer control member for controlling the amount of the developer held on an outer circumferential face of said developing roller and simultaneously rectifying the developer; and an aggregated toner dispersion member disposed in an opposing relationship to said transport magnetic pole of said fixed magnet on the upstream side with respect to the position of said developer control member and having a contact face in the form of a flat face with which the developer held on the outer circumferential face of said developing roller may be contacted under pressure in order to disperse aggregated toner powder in the developer held on the outer circumferential face of said developing roller;

said aggregated toner dispersion member being disposed such that said contact face is spaced by a predetermined distance from the outer circumferential face of said developing roller and an angle defined between the tangential direction to the outer circumferential face of said developing roller at the position of said transport magnetic pole of said fixed magnet and said contact face is within a predetermined angle range, wherein said aggregated toner dispersion member is disposed such that a position at which the distance between said contact face of said aggregated toner dispersion member and the outer circumferential face of said developing roller is shortest is within a predetermined range which includes the position of said transport magnetic pole of said fixed magnet of said developing roller.

3. A developing apparatus as claimed in claim 1, wherein said aggregated toner dispersion member is disposed such that the developer contacts only with a predetermined region of said contact face of said aggregated toner dispersion member.

4. A developing apparatus as claimed in claim 2, wherein said aggregated toner dispersion member is disposed such that the developer contacts only with a predetermined region of said contact face of said aggregated toner dispersion member.

5. A developing apparatus as claimed in claim 1, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

6. A developing apparatus as claimed in claim 2, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

7. A developing apparatus as claimed in claim 3, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

8. A developing apparatus as claimed in claim 4, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

9. A developing apparatus as claimed in claim 1, wherein said aggregated toner dispersion member is made of a conductive material.

10. A developing apparatus as claimed in claim 2, wherein said aggregated toner dispersion member is made of a conductive material.

11. A developing apparatus as claimed in claim 3, wherein said aggregated toner dispersion member is made of a conductive material.

12. A developing apparatus as claimed in claim 4, wherein said aggregated toner dispersion member is made of a conductive material.

13. A developing apparatus as claimed in claim 5, wherein said aggregated toner dispersion member is made of a conductive material.

14. A developing apparatus as claimed in claim 6, wherein said aggregated toner dispersion member is made of a conductive material.

15. A developing apparatus as claimed in claim 7, wherein said aggregated toner dispersion member is made of a conductive material.

16. A developing apparatus as claimed in claim 8, wherein said aggregated toner dispersion member is made of a conductive material.

17. A developing apparatus as claimed in claim 1, wherein said aggregated toner dispersion member is made of a non-magnetic material.

18. A developing apparatus as claimed in claim 2, wherein said aggregated toner dispersion member is made of a non-magnetic material.

19. A developing apparatus as claimed in claim 3, wherein said aggregated toner dispersion member is made of a non-magnetic material.

20. A developing apparatus as claimed in claim 4, wherein said aggregated toner dispersion member is made of a non-magnetic material.

21. A developing apparatus as claimed in claim 5, wherein said aggregated toner dispersion member is made of a non-magnetic material.

22. A developing apparatus as claimed in claim 6, wherein said aggregated toner dispersion member is made of a non-magnetic material.

23. A developing apparatus as claimed in claim 7, wherein said aggregated toner dispersion member is made of a non-magnetic material.

24. A developing apparatus as claimed in claim 8, wherein said aggregated toner dispersion member is made of a non-magnetic material.

25. A developing apparatus as claimed in claim 9, wherein said aggregated toner dispersion member is made of a non-magnetic material.

26. A developing apparatus as claimed in claim 10, wherein said aggregated toner dispersion member is made of a non-magnetic material.

27. A developing apparatus as claimed in claim 11, wherein said aggregated toner dispersion member is made of a non-magnetic material.

28. A developing apparatus as claimed in claim 12, wherein said aggregated toner dispersion member is made of a non-magnetic material.

29. A developing apparatus as claimed in claim 13, wherein said aggregated toner dispersion member is made of a non-magnetic material.

30. A developing apparatus as claimed in claim 14, wherein said aggregated toner dispersion member is made of a non-magnetic material.

31. A developing apparatus as claimed in claim 15, wherein said aggregated toner dispersion member is made of a non-magnetic material.

32. A developing apparatus as claimed in claim 16, wherein said aggregated toner dispersion member is made of a non-magnetic material.

33. A developing apparatus for transporting developer which includes toner powder and magnetic powder to an image carrier to perform development of said image carrier, comprising:

a developing roller including a fixed magnet having a transport magnetic pole thereon and a rotary sleeve driven to rotate around an outer periphery of said fixed magnet for holding the developer on an outer periphery of said rotary sleeve making use of a magnetic force of said fixed magnet and transporting the developer to a developing region of said image carrier so that said image carrier is developed with the developer in the developing region;

a developer control member for controlling the amount of the developer held on an outer circumferential face of said developing roller and simultaneously rectifying the developer;

a transport roller including a fixed magnet having a transport magnetic pole and a rotary sleeve driven to rotate around an outer periphery of said fixed magnet for holding the developer on an outer circumferential face of said rotary sleeve making use of a magnetic force of said fixed magnet and transporting the developer to the outer periphery of said developing roller; and an aggregate toner dispersion member disposed in an opposing relationship to said transport magnetic pole of said fixed magnet and having a contact face in the form of a flat face with which the developer held on an outer circumferential face of said transport roller may be contacted under pressure in order to disperse aggregated toner powder in the developer held on the outer circumferential face of said transport roller;

said aggregated toner dispersion member being disposed such that said contact face is spaced by a predetermined distance from the outer circumferential face of said transport roller and an angle defined between the tangential direction to the outer circumferential face of said transport roller at the position of said transport magnetic pole of said fixed magnet and said contact face is within a predetermined angle range.

34. A developing apparatus as claimed in claim 33, wherein said aggregated toner dispersion member is disposed such that a position at which the distance between said contact face of said aggregated toner dispersion member and the outer circumferential face of said transport roller is shortest is within a predetermined range which includes the position of said transport magnetic pole of said fixed magnet of said transport roller.

35. A developing apparatus as claimed in claim 33, wherein said aggregated toner dispersion member is disposed such that the developer contacts only with a predetermined region of said contact face of said aggregated toner dispersion member.

36. A developing apparatus as claimed in claim 34, wherein said aggregated toner dispersion member is disposed such that the developer contacts only with a predetermined region of said contact face of said aggregated toner dispersion member.

37. A developing apparatus as claimed in claim 33, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

38. A developing apparatus as claimed in claim 34, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

39. A developing apparatus as claimed in claim 35, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

40. A developing apparatus as claimed in claim 36, wherein said aggregated toner dispersion member is formed as a member in the form of a plate or a block, and is disposed such that a face thereof opposite to said contact face defines a predetermined angle with respect to a horizontal plane in order to prevent accumulation of the developer on the face of said aggregated toner dispersion member opposite to said contact face.

41. A developing apparatus as claimed in claim 33, wherein said aggregated toner dispersion member is made of a conductive material.

42. A developing apparatus as claimed in claim 34, wherein said aggregated toner dispersion member is made of a conductive material.

43. A developing apparatus as claimed in claim 35, wherein said aggregated toner dispersion member is made of a conductive material.

44. A developing apparatus as claimed in claim 36, wherein said aggregated toner dispersion member is made of a conductive material.

45. A developing apparatus as claimed in claim 37, wherein said aggregated toner dispersion member is made of a conductive material.

46. A developing apparatus as claimed in claim 38, wherein said aggregated toner dispersion member is made of a conductive material.

47. A developing apparatus as claimed in claim 39, wherein said aggregated toner dispersion member is made of a conductive material.

48. A developing apparatus as claimed in claim 40, wherein said aggregated toner dispersion member is made of a conductive material.

49. A developing apparatus as claimed in claim 33, wherein said aggregated toner dispersion member is made of a non-magnetic material.

50. A developing apparatus as claimed in claim 34, wherein said aggregated toner dispersion member is made of a non-magnetic material.

51. A developing apparatus as claimed in claim 35, wherein said aggregated toner dispersion member is made of a non-magnetic material.

52. A developing apparatus as claimed in claim 36, wherein said aggregated toner dispersion member is made of a non-magnetic material.

53. A developing apparatus as claimed in claim 37, wherein said aggregated toner dispersion member is made of a non-magnetic material.

54. A developing apparatus as claimed in claim 38, wherein said aggregated toner dispersion member is made of a non-magnetic material.

55. A developing apparatus as claimed in claim 39, wherein said aggregated toner dispersion member is made of a non-magnetic material.

56. A developing apparatus as claimed in claim 40, wherein said aggregated toner dispersion member is made of a non-magnetic material.

57. A developing apparatus as claimed in claim 41, wherein said aggregated toner dispersion member is made of a non-magnetic material.

58. A developing apparatus as claimed in claim 42, wherein said aggregated toner dispersion member is made of a non-magnetic material.

59. A developing apparatus as claimed in claim 43, wherein said aggregated toner dispersion member is made of a non-magnetic material.

60. A developing apparatus as claimed in claim 44, wherein said aggregated toner dispersion member is made of a non-magnetic material.

61. A developing apparatus as claimed in claim 45, wherein said aggregated toner dispersion member is made of a non-magnetic material.

62. A developing apparatus as claimed in claim 46, wherein said aggregated toner dispersion member is made of a non-magnetic material.

63. A developing apparatus as claimed in claim 47, wherein said aggregated toner dispersion member is made of a non-magnetic material.

64. A developing apparatus as claimed in claim 48, wherein said aggregated toner dispersion member is made of a non-magnetic material.

* * * * *